US009420830B2

(12) United States Patent
Liu

(10) Patent No.: US 9,420,830 B2
(45) Date of Patent: Aug. 23, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 757 days.

(21) Appl. No.: 13/904,806

(22) Filed: May 29, 2013

(65) Prior Publication Data

US 2014/0305451 A1 Oct. 16, 2014

Related U.S. Application Data

(63) Continuation of application No. PCT/CN2013/074085, filed on Apr. 11, 2013.

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2013/0192618 A1* 8/2013 Li ..... A24F 47/008 131/329

FOREIGN PATENT DOCUMENTS

| | | | |
|---|---|---|---|
| CN | 101606758 | A | 12/2009 |
| CN | 102106611 | A | 6/2011 |
| CN | 202496404 | U | 10/2012 |
| CN | 202750708 | U | 2/2013 |
| WO | 2011065754 | A2 | 6/2011 |

OTHER PUBLICATIONS

International Search Report mailed Jan. 9, 2014 in International Application No. PCT/CN2013/074085 filed Apr. 11, 2013.

* cited by examiner

*Primary Examiner* — Michael J Felton
(74) *Attorney, Agent, or Firm* — Tim Tingkang Xia, Esq.; Locke Lord LLP

(57) ABSTRACT

The present invention discloses an electronic cigarette, including a cigarette holder and an atomizer, a sealing ring mounted between the cigarette holder and the atomizer. The sealing ring includes a main body and a ring-shaped flange extending form the periphery to the center of the main body; one end of the flange near the cigarette holder is provided with a first slope; and the dip direction from outside to inside of the first slope is away from the cigarette holder. The electronic cigarette enables the tar condensed on the cigarette flow back to the atomizer, which can make full use of the tar.

7 Claims, 2 Drawing Sheets

ELECTRONIC CIGARETTE

CROSS-REFERENCE TO RELATED APPLICATIONS

This application is a continuation of International Patent Application No. PCT/CN2013/074085, with an international filing date of Apr. 11, 2013, designating the United States, now pending. The contents of these specifications are incorporated herein by reference.

FIELD OF THE INVENTION

The present invention relates to the technical field of electrical heating products, and more particularly relates to an electronic cigarette.

BACKGROUND OF THE INVENTION

When a current electronic cigarette simulates a smoking process, an electrical heating wire generates heat and produces smoke, and inhaled air flows takes the smoke out though a cigarette holder. A sealing ring is mounted under the cigarette holder to avoid tar leakage via joints of the cigarette holder and a protecting jacket. In the prior art, one kind of sealing ring is in tight contact with an outer wall of a breather pipe, and another kind of sealing ring is integrated with the breather pipe, particularly, the sealing ring extends axially to form the breather pipe. However, such structures and assembly methods of sealing rings are unable to avoid tar condensation inside the cigarette holder, which makes the condensed tar inside the cigarette tar may often be sucked into mouths of smokers.

SUMMARY OF THE INVENTION

Aiming at the drawbacks in the prior art that the condensed tar inside the cigarette tar may often be sucked into mouse when smoking, an electronic cigarette which enables the condensed cigarette tar to flow back to the atomizer is provided.

Wherein such electronic cigarette is provided, including a cigarette holder and an atomizer, a sealing ring mounted between the cigarette holder and the atomizer, wherein, the sealing ring includes a main body and a ring-shaped flange extending form the periphery to the center of the main body;

one end of the flange near the cigarette holder is provided with a first slope; the surface of the first slop from outside to inside is inclined along the direction being far away from the cigarette holder.

The electronic cigarette further includes a protecting jacket; both the atomizer and the sealing ring are received inside the protecting jacket; and a first acute angle formed by the first slope and an axis of the protecting jacket ranges from 25° to 90°.

The cigarette holder is mounted at one end of the protecting jacket;

The cigarette holder includes a cover and defines a first hole; the cover axially extends inwards to form an air guiding part; and the first hole runs through both the air guiding part and the cigarette holder to communicate with external air.

A breather pipe is received inside the atomizer, and a tar storing cotton is set around the breather pipe.

Both the first slope and the breather pipe are round, and are set coaxially with the ring-shaped flange.

An inner diameter of the flange is bigger than an outer diameter of the breather pipe, and a difference between the inner diameter of the flange and the outer diameter of the breather pipe is bigger or equal to 0.4 mm, and less than 14 mm.

A minimum of a vertical distance between the first slope and the air guide part is bigger than or equal to 0.5 mm, and less than 30 mm.

Another end of the flange that is away from the cigarette holder is provided with a second slope; the surface of the second slop from outside to inside is inclined along the direction being towards the cigarette holder.

A second acute angle formed by the second slope and the axis of the protecting jacket ranges from 1° to 90°.

An end of the flange that is away from the cigarette holder is a planar surface.

An area of the first hole ranges from 2 $mm^2$ to 7 $mm^2$.

When implementing the invention, the following advantages can be achieved: in this invention, by forming the first slope on the sealing ring, the tar condensed on the cigarette holder can be dropped onto the first slope and then flows back to the atomizer along the first slope. Thus, the tar is fully utilized and can also be prevented from being sucked by users.

BRIEF DESCRIPTION OF THE DRAWINGS

The present invention can be further illustrated by reading the example with references made to the accompanying drawings, in which.

DETAILED DESCRIPTION OF THE PREFERRED EMBODIMENT

For recognizing the technique character, the object and the effect more clearly, the special implement of the invention is illustrated in detail with references to the accompanying drawings.

Figure 1:
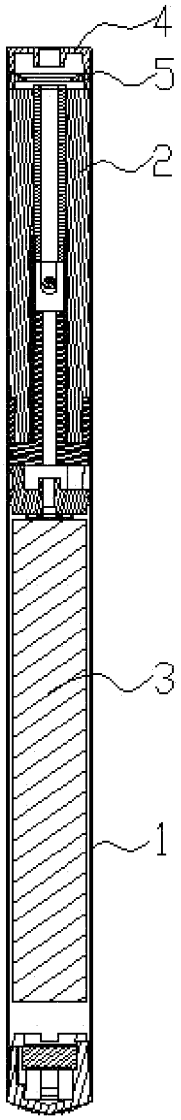
FIG. 1 is a schematic view of an inner structure of an electronic cigarette of the invention.
Figure 2:
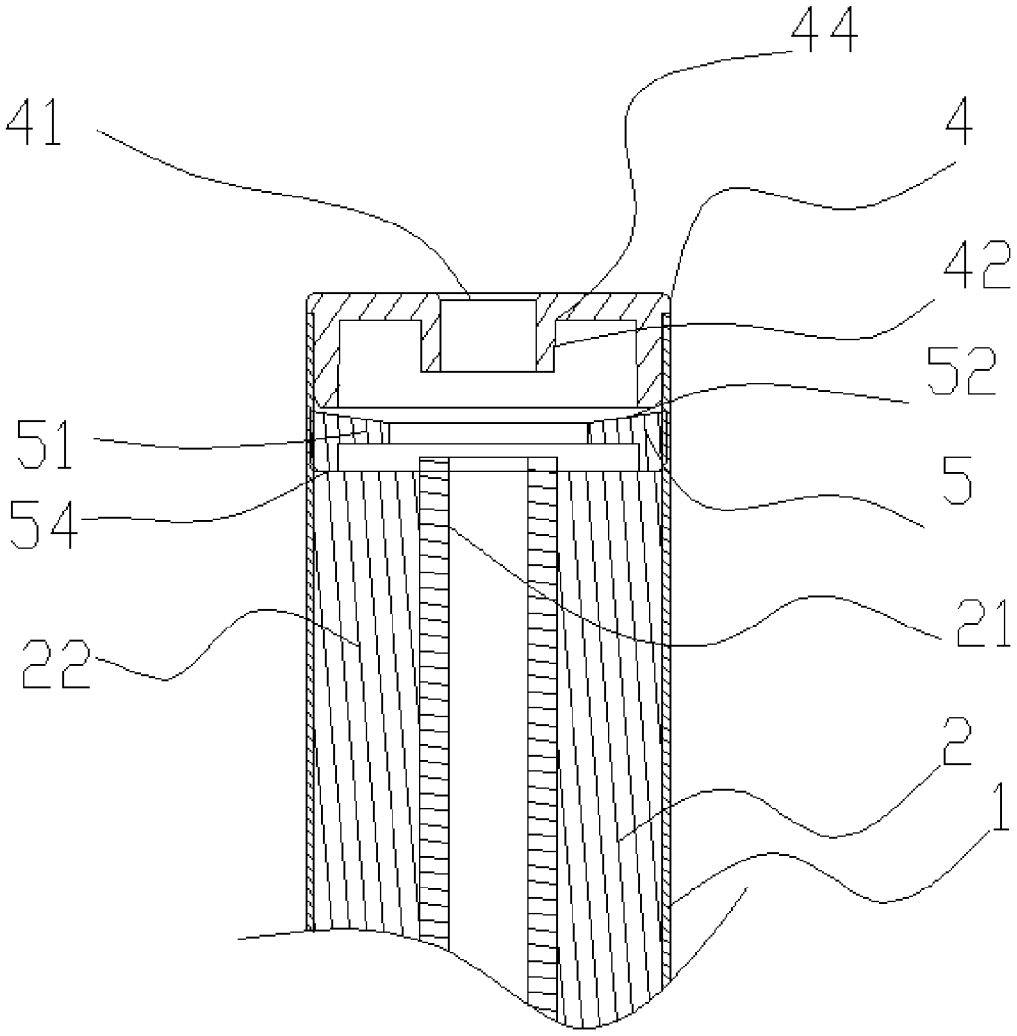
FIG. 2 is a partially enlarged view of FIG. 1.

As shown in FIG. 1 and FIG. 2, an electronic cigarette is provided. The electronic cigarette includes a protecting jacket 1, an atomizer 2 a cigarette holder 4. A sealing ring 5 is mounted between the cigarette holder 4 and the atomizer 2.

The sealing ring 5 includes a main body 54 and a ring-shaped flange 51 extending from the peripheral of the main body 54 to the center of the main body 54. One end of the flange 51 near the cigarette holder 4 is provided with a first slope 52. The surface of the first slop 52 from outside to inside is inclined along the direction being far away from the cigarette holder 4, wherein, the outside of the first slope 52 is the side besides the protecting jacket 1, and the inside of the first slope 52 is the side that is near to the axis of the protecting jacket 1.

In specific, space surrounded by the flange 51 and space surrounded by the sealing ring 5 cooperatively form a shoulder hole.

By mounting the first slope 51 at one end of the flange 51 near to the cigarette holder 4, the tar condensed on the cigarette holder 4 can firstly drops onto the first flange 51 and then flows back to the atomizer 2 along the first slope 52. Thus, the circumfluence of the tar is facilitated, and the tar is fully utilized and can also be prevented from being sucked by users.

Understandably, the electronic cigarette further includes the protecting jacket 1, and both the atomizer 2 and the sealing ring 5 are received inside the protecting jacket 1. One end of the electronic cigarette holder 4 that is away from the cigarette holder 4 is provided with a battery rod 3, and the battery rod 3 is also mounted inside the protecting jacket 1.

Preferably, a first acute angle formed by the first slope 52 and an axis of the protecting jacket 1 ranges from 25° to 90°, that is, the acute angle formed by the first slope 52 and a plane that is perpendicular to the axis of the protecting jacket 1 can be any value ranged from 25° to 75°. In fact, the acute angle formed by the first slope 52 and the plane that is perpendicular to the axis of the protecting jacket 1 can be any angle ranged from 0° to 90°, as long as the first slope 52 enables the tar to flow along the first slope 52. As a preferred selection, the first acute angle is 30° in the invention.

The cigarette holder 4 is mounted at one end of the protecting jacket 1. The cigarette holder 4 includes a cover 44 and a connection part, and the connection part is inserted in the protecting jacket 1. The connection way between the cigarette holder 4 and the protecting jacket 1 can be threaded connection, interference fit joint, or other joint ways such as adhesive connection. In the invention, the cigarette holder 4 and the protecting jacket 1 are connected with each other by interference fit joint.

By mounting the sealing ring 5 between the cigarette holder 4 and atomizer 2, the tar leakage from the joint of the cigarette holder 4 and protecting jacket 1 can be avoided. In specific, the sealing ring 5 is inserted in the protecting jacket 1, and the connection way between the sealing ring 5 and the protecting jacket 1 is interference fit joint.

A breather pipe 21 is received inside the atomizer 2; and a tar storing cotton 22 is set around the breather pipe 21.

The cigarette holder 4 further defines a first hole 41, the cover 44 axially extends inwards to form an air guiding part 42, and the first hole 41 runs through both the air guiding part 42 and the cover 44 to communicate with external air. Understandably, one purpose of setting the air guiding part 42 is to enable atomized air to outflow via the air guiding part 42 and the first hole 41 when smoking is simulated. Another purpose of setting the air guiding part 42 is to form parts around the first hole 41 to protect the tar from being sucked into mouths when smoking is simulated (i.e., the outer wall of the air guiding part 42). A third purpose of setting the air guiding part 42 is to enable the tar to drop down along the outer wall of the air guide part 42.

As a preferred embodiment, both the first hole 41 and the breather pipe 21 are round, and are set coaxially with the flange 51.

In specific, an inner diameter of the flange 51 is bigger than an outer diameter of the breather pipe 21. A difference between the inner diameter of the flange 51 and the outer diameter of the breather pipe 31 is bigger than or equal to 0.4 mm, and less than 14 mm. By forming the diameter difference between the inner diameter of the flange 51 and the outer diameter of the breather pipe 21, the tar dropped to the flange 51 is enabled to flow into the air storing cotton 22 along the inner wall of the flange 51 due to gravity.

Preferably, an inner diameter of the first hole 41 is equal to an inner diameter of the breather pipe 21. In this way, an air outflow velocity during smoking processes is substantially equal to an air flowing velocity in the electronic cigarette.

A minimum of a vertical distance between the first slope 52 and the air guide part 42 is bigger than or equal to 0.5 mm, and less than 30 mm. Thus, a distance between an end of air guide part 42 facing the breather pipe 21 and the first slope 52 is prevented from being too short, and the tar condensed on the first slope 52 and the tar dropped onto the first slope 52 from the cigarette holder 4 are prevented from being sucked through the first hole 41 by users.

Understandably, a second slope can also be formed on another end of the flange 51 that is away from the cigarette holder 4. The surface of the second slop from outside to inside is inclined along the direction being towards the cigarette holder 4, wherein, the outside of the second slope is the side that is near to the inner wall of the protecting jacket 1, and the inside of the second slope is the side that is near to the axis of the protecting jacket 1. A second acute angle formed by the second slope and the axis of the protecting jacket 1 ranges from 1° to 90°. Preferably, the second acute angle is 30°.

Understandably, an end of the flange 51 away from the cigarette holder 4 can also be a cambered surface, which can also guide the tar to flow.

Furthermore, the end of the flange 51 away from the cigarette holder 4 can also be a planar surface. Though the plane surface doesn't have the tar guide function as the second slope or the cambered surface, the inside diameter of the flange 51 is bigger than the outside diameter of the breather pipe 21, and the tar dropped onto the first slope 52 can flow to the tar storing cotton 22 along the inner side of the flange 51 due to gravity.

Understandably, the existence of the second slope can make the tar flow to the second slope along the inner side of the first slope 52, and eventually drop to the tar storing cotton 22 under the guiding function of the second slope.

An area of the first hole 41 ranges from 2 $mm^2$ to 7 $mm^2$, which can ensure the flowing velocity of the atomized air that flows though the first hole 41 to be acceptable.

In conclusion, in the invention, the first slope 52 is mounted on the end of the flange 51 that is near to the cigarette holder 4, and the surface of the first slop 52 from outside to inside is inclined along the direction being far away from the cigarette holder 4. The tar condensed on the cigarette holder 4 can flow back to the tar storing part 22 of the atomizer 2 along the first slope 52, which protects the user from sucking tar and makes full use of the tar.

While the present invention has been described by reference to preferred embodiments, it will be understood by those skilled in the art that various changes may be made and equivalents may be substituted without departing from the scope of the present invention. However, all the changes will be included within the scope of the appended claims.

What is claimed is:

1. An electronic cigarette, including a cigarette holder and an atomizer, a sealing ring mounted between the cigarette holder and the atomizer, wherein, the sealing ring includes a main body and a ring-shaped flange extending form the periphery to the center of the main body;

one end of the flange near the cigarette holder is provided with a first slope; the first slope surface from outside to inside is inclined along the direction being far away from the cigarette holder, a protecting jacket wherein both the atomizer and the sealing ring are received inside the protecting jacket;

a first acute angle formed by the first slope and an axis of the protecting jacket ranges from 250 to 900, wherein, the cigarette holder is mounted at one end of the protecting jacket;

the cigarette holder includes a cover and defines a first hole; the cover axially extends inwards to form an air guiding part, the first hole runs through both the air guiding part and the cigarette holder to communicate with external air, wherein, a breather pipe is received inside the atomizer, and a tar storing cotton is set around the breather pipe, and wherein, both the first slope and the breather pipe are round, and are set coaxially with the ring-shaped flange.

2. The electronic cigarette of claim 1, wherein, an inner diameter of the flange is bigger than an outer diameter of the breather pipe, and a difference between the inner diameter of the flange and the outer diameter of the breather pipe is bigger or equal to 0.4 mm, and less than 14 mm.

3. The electronic cigarette of claim 2, wherein, a minimum of a vertical distance between the first slope and the breather pipe part is bigger than or equal to 0.5 mm, and less than 30 mm.

4. The electronic cigarette of claim 1, wherein, another end of the flange that is away from the cigarette holder is provided with a second slope; and the surface of the second slope from outside to inside is inclined along the direction being towards the cigarette holder.

5. The electronic cigarette of claim 4, wherein, a second acute angle formed by the second slope and the axis of the protecting jacket ranges from 1° to 90°.

6. The electronic cigarette of claim 1, wherein, an end of the flange that is away from the cigarette holder is a planar surface.

7. The electronic cigarette of claim 1, wherein, an area of the first hole ranges from 2 $mm^2$ to 7 $mm^2$.

* * * * *